US010280024B2

(12) United States Patent
Niu et al.

(10) Patent No.: US 10,280,024 B2
(45) Date of Patent: May 7, 2019

(54) FILM FEEDING APPARATUS AND CONTROL METHOD THEREOF

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Honglin Niu, Beijing (CN); Ronghua Fan, Beijing (CN); Jinbao Zhang, Beijing (CN); Xutong Chen, Beijing (CN); Duanduan Ding, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days.

(21) Appl. No.: 15/292,331

(22) Filed: Oct. 13, 2016

(65) Prior Publication Data

US 2017/0197799 A1 Jul. 13, 2017

(30) Foreign Application Priority Data

Jan. 11, 2016 (CN) ..... 2016 1 0015200

(51) Int. Cl.
*B65H 20/10* (2006.01)

(52) U.S. Cl.
CPC ... *B65H 20/10* (2013.01); *B65H 2301/44336* (2013.01); *B65H 2801/61* (2013.01)

(58) Field of Classification Search
CPC ..... B65H 3/08; B65H 3/0883; B65H 5/08; B65H 5/22; B65H 5/222; B65H 5/228;
(Continued)

(56) References Cited

U.S. PATENT DOCUMENTS 4,637,599 A 1/1987 Eerola
4,696,465 A 9/1987 Willi
(Continued)

FOREIGN PATENT DOCUMENTS

CN 200951839 Y 9/2007
CN 201261655 Y 6/2009
(Continued)

OTHER PUBLICATIONS

The Second Chinese Office Action dated Jun. 19, 2017; Appln. No. 201610015200.3.
(Continued)

*Primary Examiner* — Michael C McCullough
(74) *Attorney, Agent, or Firm* — Ladas & Parry LLP

(57) ABSTRACT

A film feeding apparatus and a control method thereof are provided. The film feeding apparatus comprises a delivery head. A surface of the delivery head has an air suction region and an air blowing region, and the air suction region and the air blowing region respectively include an air hole; and by cooperation of air suctioning through the air hole of the air suction region and air blowing through the air hole of the air blowing region, a film is kept nearby the delivery head in a non-contact manner in the case that the delivery head adsorbs the film.

6 Claims, 4 Drawing Sheets

(58) Field of Classification Search
CPC ..... B65H 2406/11; B65H 2406/112; B65H 2406/113; B65H 2406/343; B65H 2406/364; B65H 2406/365; B65H 20/10
See application file for complete search history.

(56) References Cited

U.S. PATENT DOCUMENTS 7,530,778 B2 * 5/2009 Yassour ..... B65G 51/03 384/12
7,604,439 B2 * 10/2009 Yassour ..... B24B 37/30 406/86
8,317,185 B1 * 11/2012 Herrmann ..... B65H 3/0833 271/105
8,690,489 B2 * 4/2014 Richman ..... B65G 51/03 271/3.23
9,010,925 B2 * 4/2015 Leighton ..... B41J 11/0085 347/104
9,120,344 B2 * 9/2015 Lowrance ..... B41J 25/308
2011/0023757 A1 2/2011 Richman et al.
2012/0031147 A1 * 2/2012 Arai ..... B23K 26/0057 65/182.2
2012/0311147 A1 12/2012 Keskitalo
2013/0038649 A1 * 2/2013 Lowrance ..... B41J 25/308 347/8
2016/0193856 A1 * 7/2016 Haenen ..... B41J 11/007 347/104

FOREIGN PATENT DOCUMENTS

CN 201770338 U 3/2011
CN 102026560 A 4/2011

OTHER PUBLICATIONS

First Chinese Office Action dated Dec. 5, 2016; Appln. No. 201610015200.3.

* cited by examiner

FILM FEEDING APPARATUS AND CONTROL METHOD THEREOF

TECHNICAL FIELD

Embodiments of the present disclosure relate to a film feeding apparatus and a control method thereof.

BACKGROUND

A liquid crystal display device comprises a display panel and a chip on film (COF) attached to the display panel. The COF connects the display panel with a driving circuit, so that a driving signal generated by the driving circuit is transmitted to the display panel via the COF so as to drive the display panel to display. The driving circuit is generally arranged on a back side of the display panel.

SUMMARY

According to embodiments of the disclosure, a film feeding apparatus comprising a delivery head is provided. A surface of the delivery head has an air suction region and an air blowing region, and the air suction region and the air blowing region respectively include an air hole; and by cooperation of air suctioning through the air hole of the air suction region and air blowing through the air hole of the air blowing region, a film is kept nearby the delivery head in a non-contact manner in the case that the delivery head adsorbs the film.

For example, the air suction region is in centrosymmetric distribution with respect to a center of the surface of the delivery head, and the air blowing region is in centrosymmetric distribution with respect to the center of the surface of the delivery head.

For example, the surface of the delivery head has two regions, one region is the air suction region and the other region is the air blowing region, and the air suction region surrounds the air blowing region or the air blowing region surrounds the air suction region.

For example, the air suction region forms one air hole or the air suction region includes a plurality of air holes; and/or the air blowing region forms one air hole or the air blowing region includes a plurality of air holes.

For example, the surface of the delivery head includes a plurality of air suction regions and a plurality of air blowing regions, and the plurality of air suction regions and the plurality of air blowing regions are alternately arranged.

For example, each air suction region forms one air hole or each air suction region includes a plurality of air holes; and/or each air blowing region forms one air hole or each air blowing region includes a plurality of air holes.

For example, the surface of the delivery head includes a plurality of air suction regions and a plurality of air blowing regions, the air suction regions are in axially symmetrical distribution with respect to a center line of the surface of the delivery head, the air blowing regions are in axially symmetrical distribution with respect to the center line of the surface of the delivery head, and the plurality of air suction regions and the plurality of air blowing regions are alternately arranged.

For example, each air suction region forms one air hole or each air suction region includes a plurality of air holes; and/or each air blowing region forms one air hole or each air blowing region includes a plurality of air holes.

For example, the surface of the delivery head includes a plurality of air suction regions and a plurality of air blowing regions, the air suction regions are in axially symmetrical distribution with respect to a center line of the surface of the delivery head, the air blowing regions are in axially symmetrical distribution with respect to the center line of the surface of the delivery head, and the air suction regions are located on two sides of the air blowing regions.

For example, each air suction region forms one air hole or each air suction region includes a plurality of air holes; and/or each air blowing region forms one air hole or each air blowing region includes a plurality of air holes.

For example, the surface of the delivery head includes a plurality of air suction regions and a plurality of air blowing regions, the air suction regions are in axially symmetrical distribution with respect to a center line of the surface of the delivery head, the air blowing regions are in axially symmetrical distribution with respect to the center line of the surface of the delivery head, and the air blowing regions are located on two sides of the air suction regions.

For example, each air suction region forms one air hole or each air suction region includes a plurality of air holes; and/or each air blowing region forms one air hole or each air blowing region includes a plurality of air holes.

For example, the film is a chip on film.

According to the embodiments of the disclosure, a control method of a film feeding apparatus is provided. The film feeding apparatus comprising a delivery head. A surface of the delivery head has an air suction region and an air blowing region, and the air suction region and the air blowing region respectively include an air hole; and the method comprises: in the case that a film is adsorbed by the delivery head, controlling air suctioning through the air hole of the air suction region to cooperate with air blowing through the air hole of the air blowing region so that the film is kept nearby the delivery head in a non-contact manner.

For example, in the case that the film is adsorbed by the delivery head, the method comprises: controlling air flow amount of the air suction region to be greater than air flow amount of the air blowing region.

For example, the method further comprises: in the case that the film is desorbed from the delivery head, controlling air suctioning through the air hole of the air suction region to cooperate with air blowing through the air hole of the air blowing region so that the film is moved away from the delivery head.

For example, in the case that the film is desorbed from the delivery head, the method comprises: controlling air flow amount of the air blowing region to be greater than air flow amount of the air suction region.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical solutions and advantages of the embodiments of the present disclosure apparent, the technical solutions of the embodiment will be described in a clearly and fully understandable way in connection with the drawings. It is obvious that the described embodiments are just a part but not all of the embodiments of the present disclosure. Based on the described embodiments of the present disclosure, those skilled in the art can obtain other embodiment(s), without any inventive work, which should be within the scope of the present disclosure.

Figure 1:
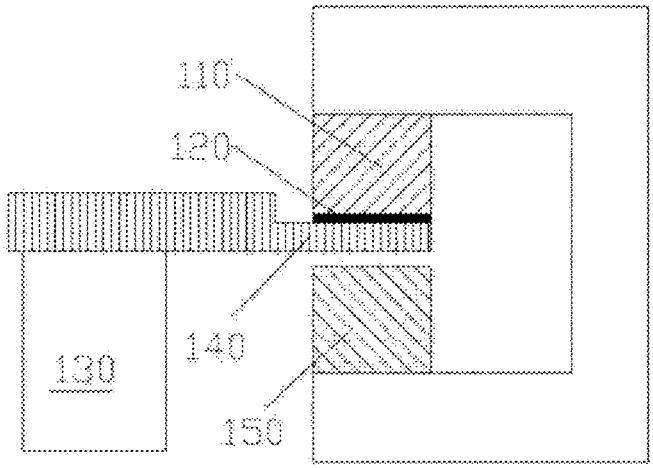
FIG. 1 is a schematic view illustrating that a delivery head adsorbs a film so as to attach the film to a display panel.

In order to attach a chip on film (COF) to a display panel, an apparatus as shown in FIG. 1 is adopted. In a process of attaching the chip on film 120 to the display panel 140, a delivery head 110 adsorbs the chip on film 120, and the display panel 140 is moved to a position of the delivery head 110 by a servo platform 130 so that the chip on film 120 is attached to the display panel 140. At a position under the display panel 140, a supporting mechanism 150 playing a supporting role is provided. Because of a high frequency of use, the delivery head 110 adsorbing the chip on film is abraded easily, resulting in that the COF adsorbed by the delivery head 110 has pressing marks, attaching precision is not stable, and a COF production line utilization rate and quality are affected.

Embodiments of the present disclosure provide a film feeding apparatus, comprising: a delivery head. A surface of the delivery head has an air suction region and an air blowing region, and the air suction region and the air blowing region respectively include an air hole. By cooperation of air suctioning through the air hole of the air suction region and air blowing through the air hole of the air blowing region, a film is kept nearby the delivery head in a non-contact manner in the case that the delivery head adsorbs the film.

In the case that the film is adsorbed, the air hole of the air suction region is controlled to perform air suctioning, the air hole of the air blowing region is controlled to perform air blowing, and air flow amount of the air suction region is controlled to be greater than that of the air blowing region, so that the film is kept nearby the delivery head in the non-contact manner. In the case that the film is desorbed, the air hole of the air suction region is controlled to perform air suctioning, the air hole of the air blowing region is controlled to perform air blowing, and the air flow amount of the air suction region is controlled to be smaller than that of the air blowing region, so that the film is moved away from the delivery head. For example, the air flow amount is controlled through air flow intensity, sizes of the air holes, density of the air holes and/or other conditions.

By using the film feeding apparatus of the embodiments of the present disclosure, in the case that the film is adsorbed by the delivery head, the film is not in contact with the delivery head and a gap exists between the film and the delivery head, and therefore the delivery head is not abraded. In addition, in the case that the attaching precision is not affected, the greater the gap between the film and the delivery head, the better the delivery head is protected. For example, the gap between the film and the delivery head is adjusted by controlling the air flow amount. In the case that the film is a chip on film (COF), because the delivery head is not in direct contact with the COF, no pressing marks exist on a surface of the COF; by cooperation of air suctioning and air blowing, the COF is attached stably, it is guaranteed that attaching precision of the COF is within a predetermined range to the maximum extent, a production line utilization rate is increased, and product quality is improved. For example, the predetermined range mentioned here refers to that errors between the delivery head and the film in a horizontal direction and a vertical direction do not exceed 0.1 mm.

For example, the air holes are in a shape of a circle, a triangle, a rectangle or in any other irregular shape.

Figure 2:
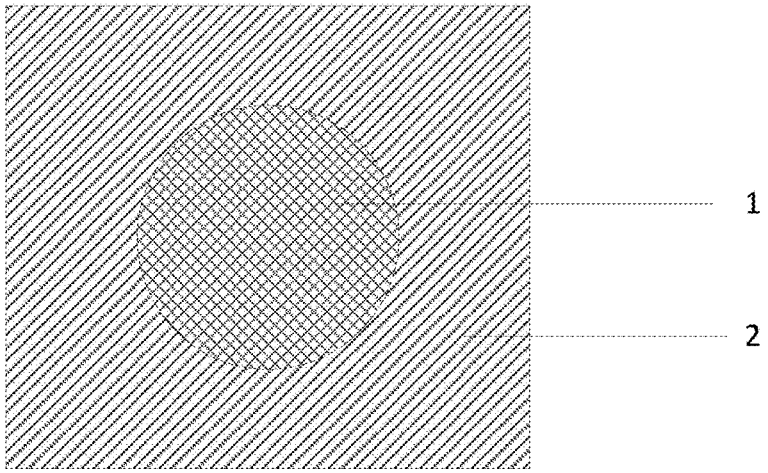
FIGS. 2 to 8 show a surface structural schematic view of a delivery head of a film feeding apparatus according to embodiments of the present disclosure.

For example, as shown in FIG. 2, in order to absorb the film smoothly and steadily, the air suction region 1 is in centrosymmetric distribution with respect to a center of the surface of the delivery head, and the air blowing region 2 is in centrosymmetric distribution with respect to the center of the surface of the delivery head. For example, the surface of the delivery head has two regions, one region is the air suction region, the other region is the air blowing region, and the air suction region surrounds the air blowing region of the air blowing region surrounds the air suction region. As an example, FIG. 2 shows that the air blowing region 2 surrounds the air suction region 1, the whole air suction region 1 forms one air hole, and the whole air blowing region 2 forms one air hole. It should be understood that, in FIG. 2, a position of the air suction region 1 and a position of the air blowing region 2 can be interchanged, that is to say, the air suction region 1 surrounds the air blowing region 2.

Figure 3:
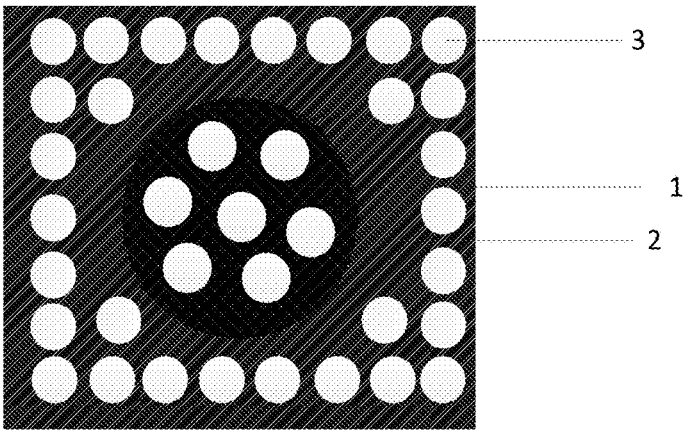

For example, as shown in FIG. 3, on a basis of the delivery head structure shown in FIG. 2, the air suction region 1 and the air blowing region 2 respectively include a plurality of air holes 3. For example, the plurality of air holes 3 are evenly distributed. By adjusting air flow amount of the air suction region 1 and air flow amount of the air blowing region 2, adsorption or desorption of the film is achieved. It should be understood that, in FIG. 3, a position of the air suction region 1 and a position of the air blowing region 2 can be interchanged.

Figure 4:
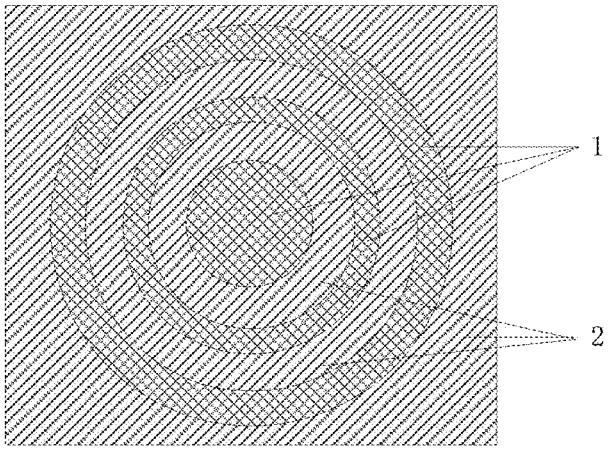

For example, as shown in FIG. 4, the surface of the delivery head includes a plurality of air suction regions 1 and a plurality of air blowing regions 2, each of the air suction regions 1 is in centrosymmetric distribution with respect to the center of the surface of the delivery head, each of the air blowing regions 2 is in centrosymmetric distribution with respect to the center of the surface of the delivery head, and the plurality of air suction regions 1 and the plurality of air blowing regions 2 are alternately arranged. For example, each air suction region 1 as a whole performs air suctioning as one air hole, or a plurality of air holes 3 are provided in each air suction region 1 to perform air suctioning. For example, each air blowing region 2 as a whole performs air blowing as one air hole, or a plurality of air holes 3 are provided in each air blowing region 2 to perform air blowing. It should be understood that, in FIG. 4, positions of the air suction regions 1 and positions of the air blowing regions 2 can be interchanged.

Figure 5:
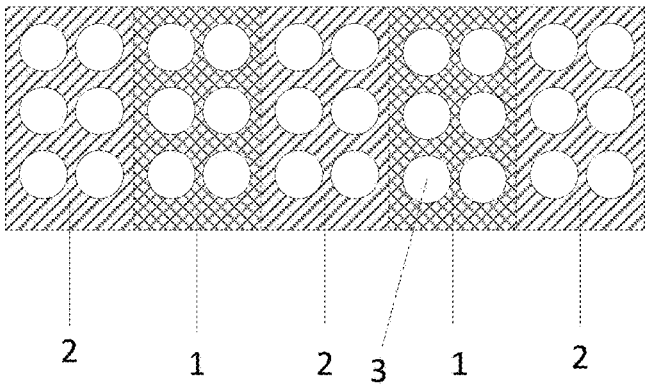
Figure 6:
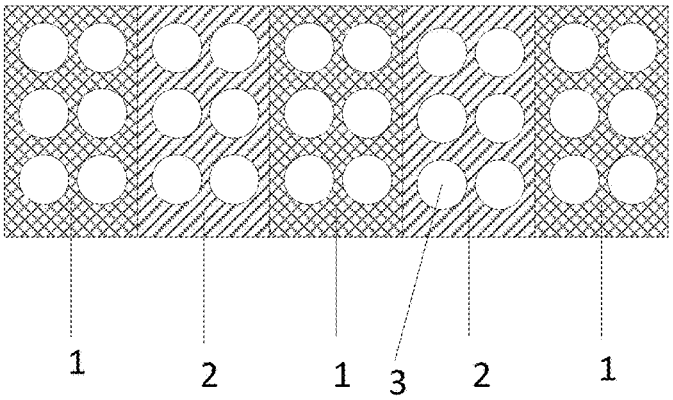

For example, as shown in FIG. 5, the surface of the delivery head includes a plurality of air suction regions 1 and a plurality of air blowing regions 2, the air suction regions 1 are in axially symmetrical distribution with respect to a center line of the surface of the delivery head, the air blowing regions 2 are in axially symmetrical distribution with respect to the center line of the surface of the delivery head, and the plurality of air suction regions 1 and the plurality of air blowing regions 2 are alternately arranged. For example, each air suction region 1 as a whole performs air suctioning as one air hole, or a plurality of air holes 3 are provided in each air suction region 1 to perform air suctioning. For example, each air blowing region 2 as a whole performs air blowing as one air hole, or a plurality of air holes 3 are provided in each air blowing region 2 to perform air blowing. It should be understood that, positions of the air suction regions 1 and positions of the air blowing regions 2 in FIG. 5 can be interchanged, so that the delivery head as shown in FIG. 6 is obtained.

Figure 7:
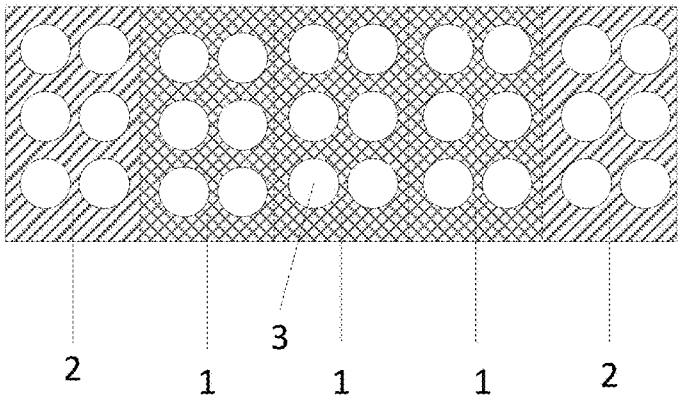

For example, as shown in FIG. 7, the surface of the delivery head includes a plurality of air suction regions 1 and a plurality of air blowing regions 2, the air suction regions 1 are in axially symmetrical distribution with respect to the center line of the surface of the delivery head, the air blowing regions 2 are in axially symmetrical distribution with respect to the center line of the surface of the delivery head, and the air blowing regions 2 are located on two sides of the air suction regions 1. For example, each air suction region 1 as a whole performs air suctioning as one air hole, or a plurality of air holes 3 are provided in each air suction region 1 to perform air suctioning. For example, each air blowing region 2 as a whole performs air blowing as one air hole, or a plurality of air holes 3 are provided in each air blowing region 2 to perform air blowing. In the case that the film is adsorbed, the air holes of the air suction regions 1 are controlled to perform air suctioning, the air holes of the air blowing regions 2 are controlled to perform air blowing, and air flow amount of the air suction regions 1 is controlled to be greater than air flow amount of the air blowing regions 2, so that the film is kept nearby the delivery head in a non-contact manner. In the case that the film is desorbed, the air holes of the air suction regions 1 are controlled to perform air suctioning, the air holes of the air blowing regions 2 are controlled to perform air blowing, and the air flow amount of the air suction regions 1 is controlled to be smaller than the air flow amount of the air blowing regions 2, so that the film is moved away from the delivery head.

Figure 8:
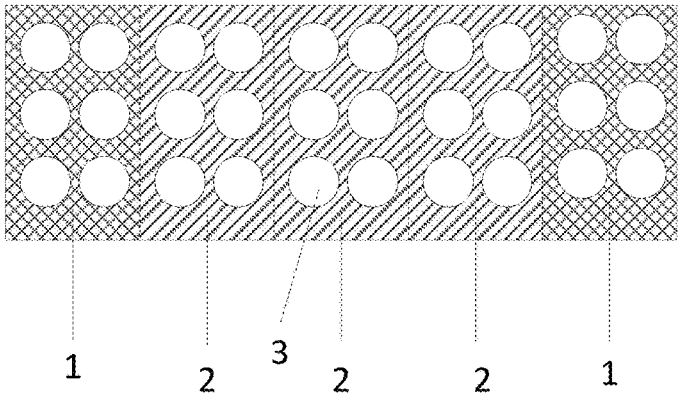

It should be noted that, positions of the air suction regions 1 and positions of the air blowing regions in FIG. 7 can be interchanged, so that the delivery head as shown in FIG. 8 is obtained, that it to say, the air suction regions 1 are located on two sides of the air blowing regions 2. For example, in FIG. 8, each air suction region 1 as a whole performs air suctioning as one air hole, or a plurality of air holes 3 are provided in each air suction region 1 to perform air suctioning. For example, in FIG. 8, each air blowing region 2 as a whole performs air blowing as one air hole, or a plurality of air holes 3 are provided in each air blowing region 2 to perform air blowing.

The embodiments of the present disclosure further provide a control method of a film feeding apparatus, for controlling the above film feeding apparatus, and the method comprises: in the case that the film is adsorbed by the delivery head, controlling air suctioning through the air hole of the air suction region to cooperate with air blowing through the air hole of the air blowing region, so that the film is kept nearby the delivery head in the non-contact manner.

For example, in the case that the film is adsorbed by the delivery head, the method comprises: controlling air flow amount of the air suction region to be greater than air flow amount of the air blowing region.

For example, in the case that the film is desorbed from the delivery head, the method comprises: controlling air suctioning through the air hole of the air suction region to cooperate with air blowing through the air hole of the air blowing region, so that the film is moved away from the delivery head. For example, in the case that the film is desorbed from the delivery head, the method comprises: controlling air flow amount of the air blowing region to be greater than air flow amount of the air suction region.

In the film feeding apparatus and the control method thereof provided by the embodiments of the present disclosure, in the case that the film is adsorbed by the delivery head, the film is not in contact with the delivery head and the gap exists between the film and the delivery head by controlling air suctioning to cooperate with air blowing, and therefore the delivery head is not abraded. In the case that the film is the chip on film (COF), because the delivery head is not in direct contact with the COF, no pressing marks exist on the surface of the COF, the COF is attached stably by cooperation of air suction and air blowing, it is guaranteed that attaching precision of the COF is within the regulated range to the maximum extent, the production line utilization rate is increased, and product quality is improved.

The foregoing embodiments merely are exemplary embodiments of the disclosure, and not intended to define the scope of the disclosure, and the scope of the disclosure is determined by tile appended claims.

The present application claims priority of Chinese Patent Application No. 201610015200.3 filed on Jan. 11, 2016, the present disclosure of which is incorporated herein by reference in its entirety as part of the present application.

The invention claimed is:

1. A film feeding apparatus, comprising a delivery head, wherein, a surface of the delivery head includes a plurality columns of air suction holes and a plurality columns of air blowing holes, the plurality columns of air suction holes are in axially symmetrical distribution with respect to a center line of the surface of the delivery head, and the plurality columns of air blowing holes are in axially symmetrical distribution with respect to the center line of the surface of the delivery head, in each column of the plurality columns of air suction holes, a plurality of air suction holes are arranged in a direction parallel to the center line of the surface of the delivery head, in each column of the plurality columns of air blowing holes, a plurality of air blowing holes are arranged in the direction parallel to the center line of the surface of the delivery head, in a direction perpendicular to the center line of the surface of the delivery head, the plurality columns of air blowing holes are respectively located on two sides of a region in which all of the plurality columns of air suction holes are provided, within the region in which all of the plurality columns of air suction holes are provided, none of the air blowing holes are provided, and on a side, facing away from the region in which all of the plurality columns of air suction holes are provided, of each of the plurality columns of air blowing holes, none of the air suction holes are provided.

2. The film feeding apparatus according to claim 1, wherein, a number of the aft suction holes in each column of the plurality columns of air suction holes is equal to a number of the air blowing holes in each column of the plurality columns of air blowing holes.

3. The film feeding apparatus according to claim 1, wherein, the film feeding apparatus delivers a film, and the film is a chip on film.

4. A film feeding apparatus, comprising a delivery head, wherein, a surface of the delivery head includes a plurality of annular air suction holes and a plurality of annular air blowing holes, the plurality of annular air suction holes and the plurality of annular air blowing holes are concentric rings, and the plurality of annular air suction holes and the plurality of annular air blowing holes are alternately arranged in a radial direction of the concentric rings.

5. The film feeding apparatus according to claim 4, wherein, the film feeding apparatus delivers a film, and the film is a chip on film.

6. A film feeding apparatus, comprising a delivery head, wherein, a surface of the delivery head includes a plurality columns of air suction holes and a plurality columns of air blowing holes, the plurality columns of air suction holes are in axially symmetrical distribution with respect to a center line of the surface of the delivery head, and the plurality columns of air blowing holes are in axially symmetrical distribution with respect to the center line of the surface of the delivery head, in each column of the plurality columns of air suction holes, a plurality of air suction holes are arranged in a direction parallel to the center line of the surface of the delivery head, in each column of the plurality columns of air blowing holes, a plurality of air blowing holes are arranged in the direction parallel to the center line of the surface of the delivery head, in a direction perpendicular to the center line of the surface of the delivery head, the plurality columns of air suction holes are respectively located on two sides of a region in which all of the plurality columns of air blowing holes are provided;

a number of the air suction holes in each column of the plurality columns of air suction holes is equal to a number of the air blowing holes in each column of the plurality columns of air blowing holes, within the region in which all of the plurality columns of air blowing holes are provided, none of the air suction holes are provided, and on a side, facing away from the region in which all of the plurality columns of air blowing holes are provided, of each of the plurality columns of air suction holes, none of the air blowing holes are provided.

* * * * *